United States Patent [19]

Schupback et al.

[11] Patent Number: 4,973,214

[45] Date of Patent: Nov. 27, 1990

[54] LIFT ARM STRUCTURE FOR FRONT-END LOADERS

[75] Inventors: Jesse L. Schupback, West Burlington; Richard D. Housman, Mediapolis, both of Iowa

[73] Assignee: J. I. Case Company, Racine, Wis.

[21] Appl. No.: 519,459

[22] Filed: May 7, 1990

[51] Int. Cl.[5] ..... B66F 9/08

[52] U.S. Cl. ..... 414/727; 172/817; 52/721; 403/167; 403/377

[58] Field of Search ..... 414/685, 722, 727, 715, 414/697; 52/721, 731; 212/266; 172/776, 817, 827; 403/167, 377, 186

[56] References Cited

U.S. PATENT DOCUMENTS

| | | | |
|---|---|---|---|
| 3,237,793 | 3/1966 | De Puy . | |
| 3,254,780 | 6/1966 | Midtbo . | |
| 4,155,470 | 5/1979 | Moore et al. | 414/727 |
| 4,538,955 | 9/1985 | Langenfeld et al. | 414/722 X |
| 4,576,543 | 3/1986 | Kuchyt et al. | 414/722 |
| 4,798,512 | 1/1989 | Intveld . | |
| 4,904,151 | 2/1990 | Biemans et al. | 414/727 |

FOREIGN PATENT DOCUMENTS

| | | | |
|---|---|---|---|
| 2379657 | 10/1978 | France | 414/722 |

*Primary Examiner*—Robert J. Spar
*Assistant Examiner*—James T. Ellen
*Attorney, Agent, or Firm*—Dressler, Goldsmith, Shore, Sutker & Milnamow, Ltd.

[57] ABSTRACT

In a front-end loader, a lift arm structure including a pair of lift arms which are rigidly joined by an improved cross-piece assembly. The cross-piece assembly includes first and second members which are configured to transversely extend one within the other between the lift arms. Along their lengths, the first and second members are separated from each other such that each is permitted to distort and absorb stress. The end portions of the first member are welded to an outside surface of the respective lift arms which the end portions of the second member are welded to an inside surface of the respective lift arms.

10 Claims, 3 Drawing Sheets

LIFT ARM STRUCTURE FOR FRONT-END LOADERS

FIELD OF THE INVENTION

The present invention relates to material handling machinery such as front-end loaders and, more particularly, to a lift arm structure for such a loader.

BACKGROUND OF THE INVENTION

A material handling machine such as a front-end loader used in agricultural or earth-moving industries typically includes a mobile-powered frame with a hydraulically operated lift arm structure connected thereto. The lift arm structure or boom assembly usually includes a pair of load-lifting arms which are each connected to the frame. Each lift arm is typically provided with its own driver for raising and lowering the respective lift arm. A loader bucket or other suitable implement is connected to a forward or distal end of each lift arm.

Most lift arm structures are also provided with a cross-piece transversely extending between the lift arms. The primary purpose of the cross-piece is to add strength and rigidity to the lift arm structure. The ends of the cross-piece are typically welded to both side surfaces of each lift arm.

During loader operation, relatively high stresses are repeatedly imparted to the lift arm structure. Such stresses include torsional as well as bending stresses. These stresses can result from any one or a series of different loader operations. As an example, a bending stress may be imparted to the lift arm structure when the loader is driven into a pile of material that is to be loaded into the bucket. As may be appreciated, the drivers connected to each of the lift arms tend to impart torsional stresses to the lift arm structure when opposite corners of the bucket have unequal vertical loads applied thereto.

It is not desirable to design the bucket to absorb the twisting and bending stresses applied to the lift arm structure. It is known, however, to provide the cross-piece with a generally circular and tubular configuration to absorb the stresses between the lift arms. The diameter of such a tube is generally restricted to the vertical side surface or width of the lift arms. To add rigidity to the lift arm structure, the wall thickness of the tubular cross-piece is maximized. Although increasing the wall thickness of the cross-piece tube will make it strong, the increase in size likewise reduces its flexibility and causes the relatively high stresses imparted to the lift arm structure to be transferred to the ends of the cross-piece rather than absorbed therebetween.

Most lift arm structures are fabricated as weldments and are, therefore, only as strong as the welds which secure the pieces together. As is appreciated, welds are extremely brittle. Their brittleness causes them to crack or fracture easily especially when relatively high stresses are repeatedly applied thereto. The high stresses imparted to the ends of a known cross-piece have been known to cause the welds securing the cross-piece to the lift arms to crack and fracture. Failure of the welds imperils the strength, rigidity and general operativeness of the lift arm structure.

SUMMARY OF THE INVENTION

In view of the above, and in accordance with the present invention, there is provided an improved cross-piece assembly for rigidly joining a pair of transversely spaced load-lifting arms of a hydraulically operated lift arm structure for a front-end loader. The improved cross-piece assembly includes first and second members which transversely extend between and are each rigidly secured to the lift arms. The first and second members are configured to extend one within the other and are separated from each other along their lengths. Providing two separate members extending one within the other and between the lift arms enhances stress distribution and absorption along the length of the cross-piece assembly by improving its flexibility while maintaining strength of the lift arm structure.

Each lift arm of the lift arm structure extends forwardly from its rearward pivotable connection to a frame of the loader. In the illustrated embodiment, each lift arm is provided with a distendable driver which imparts vertical movement to the lift arm about its connection to the frame. Moreover, each lift arm has inner and outer side surfaces. A distal end of each lift arm is normally disposed beyond a forward end of the loader and is coupled to a bucket or other suitable implement.

To allow the members of the cross-piece assembly to pass or extend one within the other, an outer member of the cross-piece assembly is configured as a relatively thin-walled tubular member. In the illustrated embodiment, the inner member of the cross-piece assembly is likewise configured as a relatively thin-walled tubular member.

In the illustrated embodiment, the inner and outer members have an ideal structural shape in the form of a circular tube for absorbing stresses imparted to the lift arm structure. Preferably, the outer tube has a diameter which is in the range of about 18 to about 24 times greater than the wall thickness thereof. Preferably, the inner tube has a diameter which is in the range of about 10 to about 18 times greater than the wall thickness thereof. During operation, each of the thin-walled members of the cross-piece assembly elastically deflect and serve to absorb stresses normally transferred to the distal end of the loader arms.

To reduce distortion of the lift arms during fabrication and to facilitate assembly of the lift arm structure, the first and second members are secured to opposite sides of each lift arm. In a most preferred form, opposite ends of the outer member are secured to the respective inner sides of the lift arms while opposite ends of the inner member are secured to respective outer sides of the lift arms. End flanges are preferably secured to opposite ends of the outer member to facilitate securement to the arms and to promote distribution of stresses to the lift arms.

Advantageously, the cross-piece assembly of the present invention is simple to fabricate and relatively inexpensive. Providing two relatively thin-walled tubular members which are unconnected along their lengths and extend one within the other between the lift arms enhances stress distribution through improved flexibility, but without detracting from the strength of the lift arm structure. Arranging first and second members one within the other does not necessitate an increase in the vertical side width of the lift arms because the cumulative cross sectional area of the two separate members comprising the cross-piece assembly provides adequate stress absorption. In addition to those advantages mentioned, the design of the present invention furthermore inhibits distortion of the lift arms during fabrication of the lift arm structure.

Numerous other advantages and features of the present invention will become apparent from the following detailed description, the accompanying drawings and the appended claims.

DETAILED DESCRIPTION OF THE PRESENT INVENTION

Figure 1:
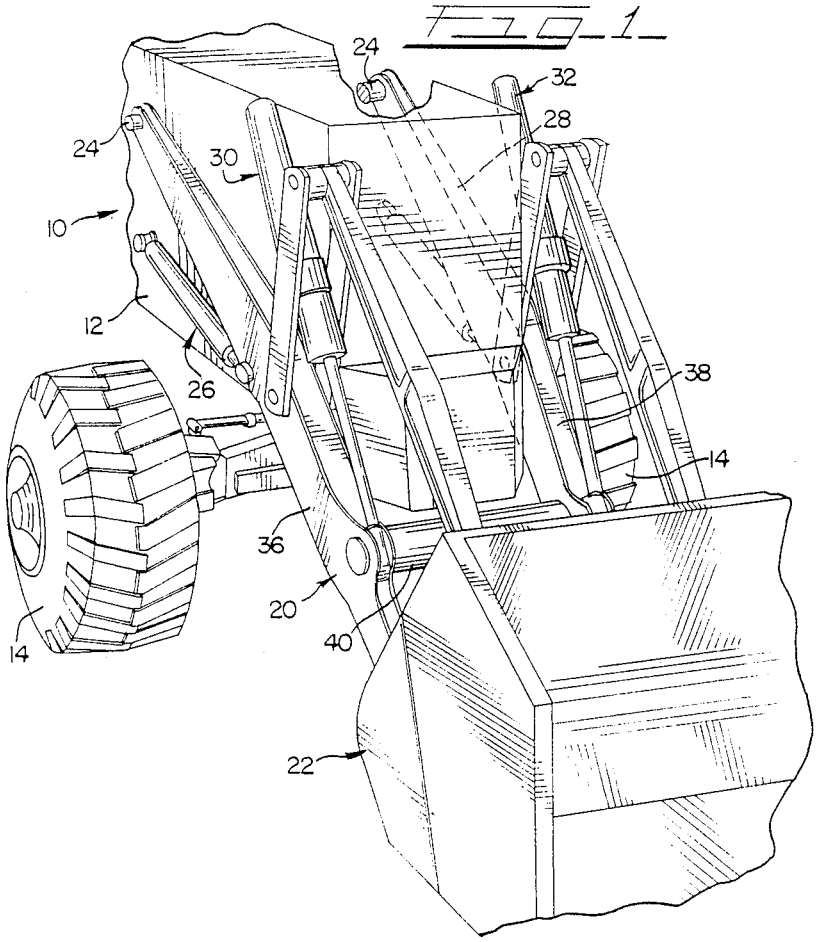
FIG. 1 is a partial perspective view of a front-end loader with a lift arm structure embodying principles of the present invention.

While the present invention is susceptible of embodiment in various forms, there is shown in the drawings, and will hereinafter be described, a preferred embodiment of the invention with the understanding that the present disclosure is to be considered as an exemplification of the invention and is not intended to limit the invention to the specific embodiment illustrated.

Referring now to the drawings, wherein like reference numerals indicate like parts throughout the several views, there is shown a material handling machine illustrated as a front-end loader 10. The loader 10 includes a mobile frame 12 adapted for movement across a ground surface. In the illustrated embodiment, the frame 12 is supported on wheels 14. The loader 10 further includes a hydraulically operated lift arm structure or boom assembly 20. A bucket 22, which is a representative example of various implements that are useful with such a loader, is coupled to a front end of the lift arm structure 20. Similar loaders have been made and sold for many years by the J. I. Case Company of Racine, Wis.

As illustrated in FIG. 1, a rear end of the lift arm structure 20 is mounted to the frame 12 by a transverse pivot 24. A pair of parallel, transversely spaced hydraulically operated load-lifting mechanisms 26 and 28, preferably including load-lifting piston-cylinders are provided to selectively lift and lower the lift arm structure 20 with bucket 22 coupled thereto about the transverse pivot 24 and relative to the frame 12. A pair of hydraulically operated, load tilting mechanisms 30 and 32, preferably including load tilting piston-cylinders, are provided for selectively tilting the bucket 22 relative to the lift arm structure.

Figure 2:
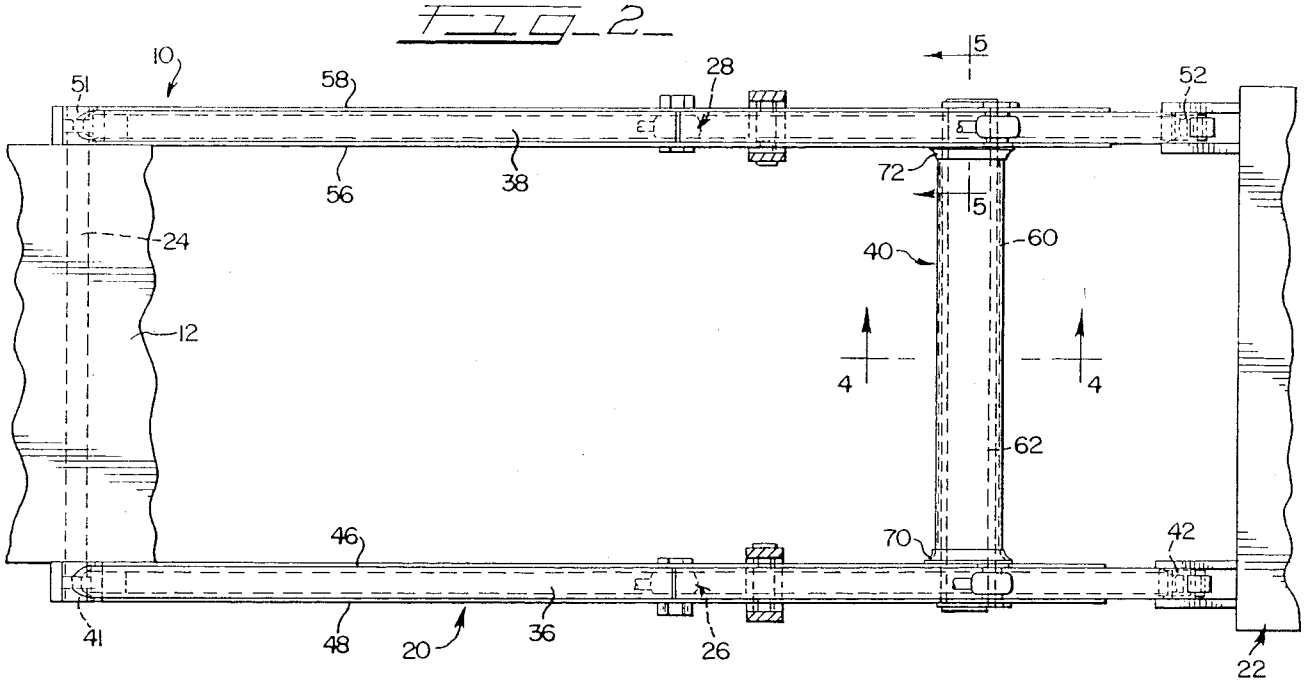
FIG. 2 is a top plan view of the lift arm structure.

As illustrated in FIG. 2, the lift arm structure 20 is a weldment basically comprised of a pair of substantially identical lift arms 36 and 38 which are rigidly joined to each other intermediate their ends by a cross-piece assembly 40. When the lift arm structure 20 is mounted to the frame 12 of machine 10, the lift arms 36 and 38 are transversely spaced from each other and are arranged toward opposite sides of the machine In the illustrated embodiment, lift arm 36 defines an aperture 41 toward a rear end thereof allowing the lift arm to be connected to the frame 12 by the transverse pivot 24. At its forward end, the lift arm 36 defines an aperture 42 which allows the bucket 22 to be coupled thereto. Intermediate its ends, the lift arm 36 is connected to load-lifting mechanism 26. The lift arm 36 furthermore defines a vertical inner side surface 46 and a vertical outer side surface 48.

Similarly, lift arm 38 defines an aperture 51 toward a rear end thereof to permit the lift arm 38 to be connected to the frame 12 by the transverse pivot 24. An aperture 52 arranged toward a forward end of arm 38 allows bucket 22 to be coupled thereto. Intermediate its ends, the lift arm 38 is connected to load-lifting mechanism 28. Lift arm 38 furthermore defines a vertical inner side surface 56 and a vertical outer side surface 58.

Figure 3:
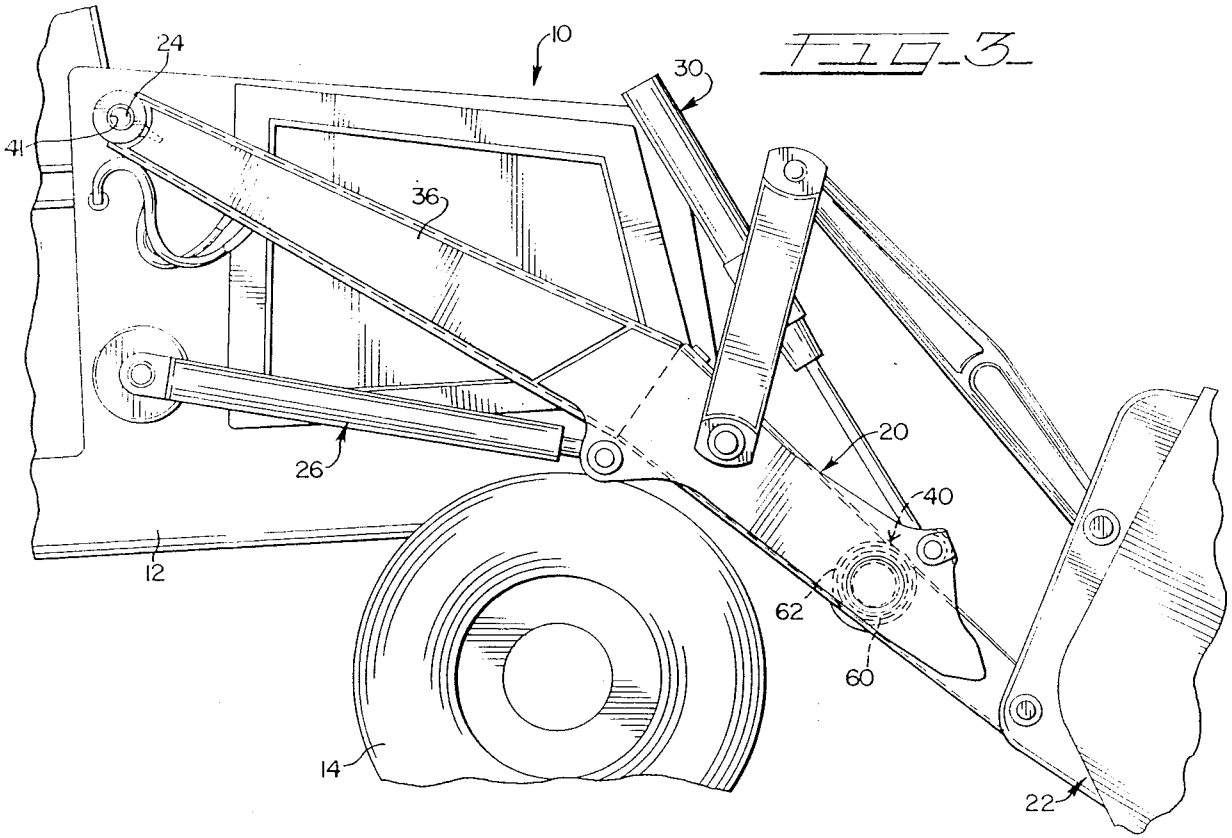
FIG. 3 is a side elevational view of the lift arm structure mounted on the loader.

The cross-piece assembly 40 rigidly joins the transversely spaced arms 36 and 38 to each other intermediate their ends. As illustrated in FIGS. 2 and 3, the cross-piece assembly 40 includes first and second members 60 and 62, respectively, extending between and rigidly secured to each of the lift arms 36 and 38. The first and second members 60, 62, respectively, are configured such that they extend one within the other and are separated from each other along their lengths.

Figure 4:
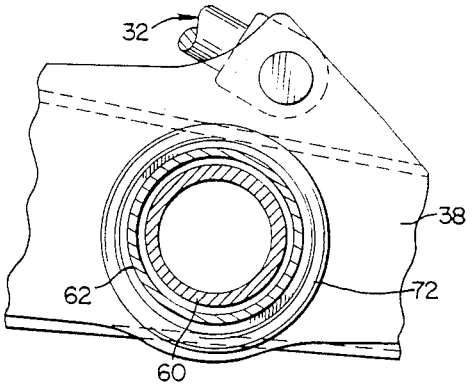
FIG. 4 is a sectional view taken along line 4—4 of FIG. 2.

Turning to FIG. 4, member 60 defines an inner member of the cross-piece assembly 40 and is preferably formed as a relatively thin-walled elongated steel tube. Member 60 is configured with an ideal structural shape for absorbing stress. As illustrated, member 60 has a circular cross-section and is preferably fabricated as a unitary structure. The inner member 60 has a diameter which is in the range of about 10 to 18 times greater than the wall thickness thereof. In a most preferred form, the inner member has a diameter which is about 12 times greater than the wall thickness thereof.

Member 62 defines an outer member of the cross-piece assembly 40 and is likewise preferably formed as a relatively thin-walled and elongated steel tube. The outer member 62 likewise has an ideal structural shape for absorbing stress. As illustrated, outer member 62 has a circular cross-sectional configuration with a diameter which is in the range of about 18 to about 24 times greater than the wall thickness thereof. In a most preferred form, the outer member 62 has a diameter which is about 22 times greater than the wall thickness thereof. Notably, the inner and outer members 60 and 62, respectively, are separated from each other along their lengths and therefore each member is capable of independent deflection and absorption of stress along its entire length.

It will be appreciated, however, that the inner and outer members 60, 62, respectively, of the cross-piece assembly 40 could be otherwise configured without detracting from the spirit and scope of the present invention. As an example, the outer member 62 could be provided with an oval or elliptical cross-sectional configuration which envelops the inner member 60. Moreover, member 62 could be comprised of at least two similar parts or pieces which are secured to each other as by welded joints extending along partially lapped seams.

Returning to FIG. 2, the first and second members 60, 62, respectively, comprising the cross-piece assembly 40 are secured to opposite side surfaces of the lift arms 36 and 38. Preferably, the cross-piece assembly 40 further includes end flanges 70 and 72, secured to opposite ends of the outer member 62, to facilitate distribution of stresses and securement to the lift arms 36 and 38.

Securement of the inner and outer members 60 and 62, respectively, of the cross-piece assembly 40 to the lift arms 36 and 38 is substantially similar at opposite ends. For purposes of succinctness and brevity, the attachment of only the lift arm 38 to cross-piece assembly 40 will be discussed in detail with the understanding that the opposite end of the cross-piece assembly 40 is attached to lift arm 36 in a substantially similar manner.

Figure 5:
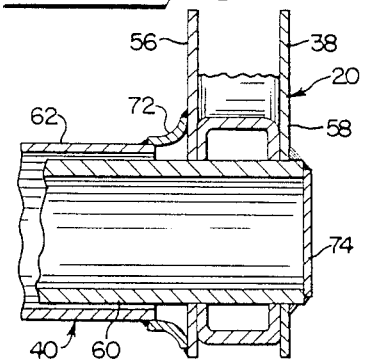
FIG. 5 is a sectional view taken along line 5—5 of FIG. 3.

As illustrated in FIG. 5, an end region of inner member 60 of the cross-piece assembly 40 extends through an opening which can be drilled, cut or otherwise provided in the lift arm 38. In the preferred embodiment, an end region of the inner member 60 is securely welded to the outer side surface 58 of the lift arm 38. A suitable cap piece 74 is welded to the end of inner member 60 to close the tube.

An end region of the outer member 62 of the cross-piece assembly 40 is securely welded to the inner side surface 56 of the lift arms. As illustrated, the inner peripheral edge of the end flange 72 is welded to the outside of the tube 62 while the outer peripheral edges of the flange 72 is welded to the inner side 56 of the lift arm 38.

The two-member construction of the cross-piece assembly 40 is advantageously simple and relatively inexpensive to fabricate and provides both flexibility and strength to the lift arm structure. As will be appreciated, providing two unallied torque transfer members between the lift arms enhances stress distribution. Moreover, arranging two relatively thin-walled tubular members one within the other and secured between the lift arms improves the elastic deflection or flexibility of the cross-piece assembly 40 without detracting from its strength. Moreover, arranging the first and second members 60, 62 one within the other yields a strengthened cross-piece assembly 40 without significantly increasing the diameter thereof and therefore does not necessitate an increase in the vertical side width of the lift arms 36, 38. In addition to those advantages mentioned, the design of the present invention further inhibits distortion of the lift arms 36, 38 during fabrication of the lift arm structure 20.

From the foregoing, it will be observed that numerous modifications and variations can be effected without departing from the true spirit and scope of the novel concept of the present invention. It will be appreciated that the present disclosure is intended to set forth an exemplification of the invention which is not intended to limit the invention to the specific embodiments illustrated. The disclosure is intended to cover by the appended claims all such modifications as fall within the scope of the claims.

What is claimed is:

1. A vertically movable lift arm structure for a material handling machine such as a front-end loader, said lift arm structure comprising:

a pair of transversely spaced arms arranged on opposite sides of the machine, each arm having one of its ends connected to said machine to allow for vertical movement thereof, with each arm extending forwardly from its connection to the machine to a distal end normally disposed beyond a forward end thereof; and cross-piece assembly means for rigidly joining said arms to each other intermediate their ends, said cross-piece assembly means including first and second members transversely extending between and rigidly secured to said arms, with said first and second members being configured to extend, one within the other and are separated along their entire lengths from each other such that they both absorb stresses imparted to and maintain strength for the lift arm structure.

2. The lift arm structure according to claim 1 wherein said first member has a generally circular cross-sectional configuration, while said second member is formed as a tube which envelops said first member.

3. The lift arm structure according to claim 2 wherein said second member has a diameter which is in a range of about 18 to about 24 times greater than a wall thickness of said second member.

4. The lift arm structure according to claim 1 wherein said first and second members are welded to opposite side surfaces on said arms to reduce distortion of said arms during fabrication of the lift arm structure.

5. The lift arm structure according to claim 2 further including means provided at opposite ends of said second member for facilitating distribution of stresses to said arms.

6. A lift arm structure for a front-end bucket loader, said lift arm structure comprising:

a pair of transversely spaced fore-and-aft extending arms arranged on opposite sides of the loader, each arm having an inner side and an outer side and is pivotally connected toward one end to said power loader; and cross-piece assembly means for rigidly joining said spaced arms to each other intermediate their ends, said cross-piece assembly means comprising an inner member transversely extending between and welded to said arms and a relatively thin-walled tubular outer member enveloping and separated along its entire length from said inner member, said outer member transversely extending between and being welded to said arms, and wherein said inner and outer members independently distort to absorb stresses along their lengths and thereby reduce the effect said stresses have on said welds.

7. The lift arm structure according to claim 6 wherein said inner member has a relatively thin-walled generally circular and tubular configuration.

8. The lift arm structure according to claim 7 wherein said inner member has a diameter which is in a range of about 10 to about 18 times greater than a wall thickness of said inner member, and wherein said outer member has a diameter which is in a range of about 18 to about 24 times greater than a wall thickness of said outer member.

9. The lift arm structure according to claim 6 wherein opposite ends of said outer member are welded to respective inner sides of said arms, while opposite ends of said inner member are welded to respective outer sides of said arms to reduce distortion of the arms during fabrication and facilitate assembly of the lift arm structure.

10. The lift arm structure according to claim 6 further including end flanges secured to opposite ends of said outer member to facilitate distribution of stresses to said arms.

* * * * *